US010869372B2

(12) United States Patent
Chen

(10) Patent No.: US 10,869,372 B2
(45) Date of Patent: Dec. 15, 2020

(54) CURRENT SOURCE CIRCUIT AND LED DRIVING CIRCUIT

(71) Applicant: SILERGY SEMICONDUCTOR TECHNOLOGY (HANGZHOU) LTD, Zhejiang (CN)

(72) Inventor: Hao Chen, Zhejiang (CN)

(73) Assignee: SILERGY SEMICONDUCTOR TECHNOLOGY (HANGZHOU) LTD, Zhejiang (CN)

( * ) Notice: Subject to any disclaimer, the term of this patent is extended or adjusted under 35 U.S.C. 154(b) by 0 days.

(21) Appl. No.: 16/446,106

(22) Filed: Jun. 19, 2019

(65) Prior Publication Data

US 2019/0394845 A1 Dec. 26, 2019

(30) Foreign Application Priority Data

Jun. 20, 2018 (CN) ..... 2018 1 0634574
Jun. 20, 2018 (CN) ..... 2018 1 0657574
Aug. 8, 2018 (CN) ..... 2018 1 0895181

(51) Int. Cl.
*H05B 45/37* (2020.01)
*H05B 45/00* (2020.01)
(Continued)

(52) U.S. Cl.
CPC ..... *H05B 45/37* (2020.01); *H05B 45/00* (2020.01)

(58) Field of Classification Search
CPC ..... H05B 45/37; H05B 45/10; H05B 45/395; H05B 45/50; H05B 45/46; H05B 45/00;
(Continued)

(56) References Cited

U.S. PATENT DOCUMENTS 8,319,448 B2 11/2012 Cecconello et al.
10,306,722 B2 5/2019 Lai et al.
(Continued)

FOREIGN PATENT DOCUMENTS

CN 101668363 A 3/2010
CN 101904217 A 12/2010
(Continued)

OTHER PUBLICATIONS

First Chinese Office Action regarding Application No. 201810895181.7 dated Aug. 27, 2019.

*Primary Examiner* — Wei (Victor) Y Chan
(74) *Attorney, Agent, or Firm* — Harness, Dickey & Pierce, P.L.C.

(57) ABSTRACT

A current source circuit and an LED driving circuit applying the same. A current at an output terminal of an operational transconductance amplifier is shunted based on a first control signal that includes duty cycle information, or an input signal at at least one input terminal of the operational transconductance amplifier is controlled to be switched between different voltage signals based on the first control signal, so as to adjust an output current of a current adjustment circuit. A driving voltage for driving a current generation circuit is adjusted based on the output current. Thereby, a driving current generated by the current source circuit is correlated with the duty cycle information. An amplitude modulation circuit used, a low-pass filter and the like for processing the first control signal are not used, effectively simplifying circuit design and improving system efficiency.

10 Claims, 7 Drawing Sheets

(51) Int. Cl.
*H05B 45/10* (2020.01)
*H05B 45/50* (2020.01)
*H05B 45/20* (2020.01)

(58) Field of Classification Search
CPC .... H05B 45/3575; H05B 45/14; H05B 47/10; H05B 45/44; H05B 45/355; H05B 45/38
USPC ..... 315/200 R, 307, 224, 186
See application file for complete search history.

(56) References Cited

U.S. PATENT DOCUMENTS

| | | | | |
|---|---|---|---|---|
| 2011/0001439 | A1 | 1/2011 | Cecconello et al. | |
| 2011/0062872 | A1* | 3/2011 | Jin | H05B 45/00 315/122 |
| 2013/0009621 | A1* | 1/2013 | Chen | G05F 1/561 323/282 |
| 2013/0154487 | A1* | 6/2013 | Kuang | H05B 45/37 315/171 |
| 2015/0102742 | A1* | 4/2015 | Deng | H05B 45/37 315/205 |
| 2018/0324916 | A1 | 11/2018 | Lai et al. | |

FOREIGN PATENT DOCUMENTS

| | | | |
|---|---|---|---|
| CN | 107094329 | A | 8/2017 |
| WO | WO-2014174159 | A1 | 10/2014 |

* cited by examiner

CURRENT SOURCE CIRCUIT AND LED DRIVING CIRCUIT

The present disclosure claims the priority to Chinese Patent Applications No. 201810634574.2, titled "CONTROL CIRCUIT", filed on Jun. 20, 2018, No. 201810657574.4, titled "CONTROL CIRCUIT" filed on Jun. 20, 2018, and No. 201810895181.7, titled "CURRENT SOURCE CIRCUIT AND LED DRIVING CIRCUIT", filed on Aug. 8, 2018, with the China National Intellectual Property Administration, the content of which are incorporated herein by reference.

FIELD

The present disclosure relates to power electronics technology, particularly to signal processing, and more particularly to a current source circuit and an LED driving circuit applying the current source circuit.

BACKGROUND

In various applications of power supplies at present, the power supply is required to modulate an analog circuit based on a control signal that includes duty cycle information, so as to meet a requirement of a load. The power supply adjusts a function relationship between a voltage for controlling an output signal and the duty cycle information, so that the output signal that drives the load is correlated with the duty cycle information. Shown in FIG. 1 is a circuit for adjusting a voltage curve. An amplitude modulation circuit 11 generates a referential duty cycle signal VD_base. The referential duty cycle signal VD_base and a control signal VD have an identical duty cycle D. Amplitude of the referential duty cycle signal VD_base is Vbase. A low pass filter 12 filters the referential duty cycle signal VD_base to generate a filtered voltage signal Vfilter. An average voltage of the filtered voltage signal is Vbase*D. The duty cycle information in the control signal VD is embodied in the filtered voltage signal Vfilter. FIG. 2 shows a waveform diagram of signals in the circuit for adjusting the voltage curve as shown in FIG. 1. In addition, a curve adjustment circuit 13 may adjust the filtered voltage signal Vfilter based on the duty cycle D of the control signal VD, so that the filtered voltage signal Vfilter changes under a desired curve, and thereby a voltage signal Vcurve is generated. The filtered voltage signal Vfilter in which the duty cycle information is embodied and the voltage signal Vcurve may be used to adjust the output signal of the power supply, such that the output signal is correlated with the duty cycle. FIG. 3 shows a corresponding function of the curve adjustment circuit 13. The filtered voltage signal Vfilter (shown by a solid line) and the voltage signal Vcurve (shown by a dash line) change in linear with the duty cycle D of the control signal VD.

In the aforementioned circuit for adjusting the voltage curve, in one aspect, the amplitude modulation circuit, the low pass filter and the curve adjustment circuit are introduced, and thereby complexity, an area and a cost for controlling the circuit is increased. In another aspect, accuracy of the control signal that includes the duty cycle information would be lost in conversion via the amplitude modulation circuit and the low-pass filter, and thereby linearity between an output voltage of the circuit for adjusting the voltage curve and the duty cycle information is affected.

SUMMARY

In view of the above, a current source circuit and an LED driving circuit applying the current source circuit are provided according to an embodiment of the present disclosure. A first control signal that includes duty cycle information directly controls an input signal or an output current of a current adjustment circuit in the current source circuit. Thereby, the output current of the current adjustment circuit is adjusted. A driving current generated by the current source is correlated with the duty cycle information, without introducing an additional amplitude modulation circuit, a low pass filter or a curve adjustment circuit. The circuit design is effectively simplified, an area and a cost of chips are reduced, and accuracy in conversion is improved.

According to a first aspect of an embodiment of the present disclosure, a current source circuit for generating a driving current is provided, including:

a current adjustment circuit, configured to receive a referential voltage signal determined by a parameter of the current source circuit, a feedback signal characterizing a driving current, and a first control signal including duty cycle information, and control an output current of the current adjustment circuit based on the first control signal;

a driving-voltage generation circuit, configured to generate a driving voltage based on the output current; and a current generation circuit, configured to generate the driving current based on the driving voltage, where the driving current is correlated with the duty cycle information.

Preferably, the current adjustment circuit includes an operational transconductance amplifier, and is configured to adjust a current at an output terminal of the operational transconductance amplifier based on the first control signal, to adjust the output current.

Preferably, a first one of the input terminals of the operational transconductance amplifier receives the referential voltage signal, and a second one of the input terminals of the operational transconductance amplifier receives the feedback signal, where:

the output current is the current at the output terminal of the operational transconductance amplifier, in a case that the first control signal is in a first state; and the output current is smaller than the current at the output terminal of the operational transconductance amplifier, in a case that the first control signal is in a second state.

Preferably, the current adjustment circuit includes a shunt circuit, where a first portion in the current at the output terminal of the operational transconductance amplifier is shunted by the shunt circuit, and a second portion remained in the current at the output terminal serves as the output current, in a case that the first control signal is in the second state.

Preferably, the shunt circuit includes:

a controllable switch, connected to the output terminal of the operational transconductance amplifier, and turned between on and off according to the first control signal; and a current source, connected in series with the controllable switch so as to shunt the first portion current at the output terminal of the operational transconductance amplifier.

Preferably, the driving-voltage generation circuit includes a filter circuit, configured to filter the output current to generate the driving voltage.

Preferably, the current generation circuit includes a transistor, where the driving voltage controls a voltage at a control terminal of the transistor to generate the driving current at a power terminal of the transistor.

Preferably, the first control signal is a PWM dimming signal, and the duty cycle information is a duty cycle of the PWM dimming signal.

Preferably, the feedback signal is linear with the duty cycle of the PWM dimming signal in a case that the duty cycle of the PWM dimming signal is less than 1; and the feedback signal is equal to the referential voltage signal in a case that the duty cycle of the PWM dimming signal is 1.

Preferably, the current source circuit further includes a first-control-signal generation circuit, where:

the first-control-signal generation circuit receives a PWM dimming signal to generate the first control signal;

the first control signal is kept in the first state, and the feedback signal is controlled to be equal to the referential voltage signal, in a case that a duty cycle of the PWM dimming signal is greater than a preset value; and the first control signal is switched between the first state and the second state, and the feedback signal is adjusted to be linear with the duty cycle, in a case that the duty cycle of the PWM dimming signal is less than or equal to the preset value.

Preferably, the first-control-signal generation circuit includes a detection circuit, configured to receive the PWM dimming signal, and detect the duty cycle of the PWM dimming signal, to generate a detection signal based on a timing reference correlated with the preset value.

Preferably, a first input signal at a first one of the input terminals of the operational transconductance amplifier is switched based on the first control signal, where:

the first input signal is the referential voltage signal in a case that the first control signal is in a first state; and the first input signal is a first voltage signal in a case that the first control signal is in a second state.

Preferably, the first control signal is a PWM dimming signal, and the duty cycle information is a duty cycle of the PWM dimming signal.

Preferably, the feedback signal is controlled to be linear with the duty cycle in a case that the duty cycle of the PWM dimming signal is less than 1, and the feedback signal is controlled to be equal to the referential voltage signal in a case that the duty cycle of the PWM dimming signal is 1.

Preferably, the current source circuit further includes a first-control-signal generation circuit, where:

the first-control-signal generation circuit receives a PWM dimming signal to generate the first control signal;

the first control signal is kept in the first state, and the feedback signal is controlled to be equal to the referential voltage signal, in a case that a duty cycle of the PWM dimming signal is greater than a preset value;

the first control signal is switched between the first state and the second state, and the feedback signal is adjusted to be linear with the duty cycle, in a case that the duty cycle of the PWM dimming signal is less than or equal to the preset value.

Preferably, the first-control-signal generation circuit includes a detection circuit, configured to receive the PWM dimming signal, and detect the duty cycle of the PWM dimming signal, to generate a detection signal based on a timing reference correlated with the preset value.

Preferably, a second one of the input terminals of the operational transconductance amplifier receives the feedback signal.

Preferably, a second input signal at a second one of the input terminals of the operational transconductance amplifier is switched based on the first control signal, where:

the second input signal is the feedback signal, in a case that the duty cycle of the PWM dimming signal is greater than a preset value; and the second input signal is switched between the feedback signal and the second voltage signal, and the feedback signal is adjusted to be linear with the duty cycle, in a case that the duty cycle of the PWM dimming signal is less than or equal to the preset value.

Preferably, the second voltage signal is a difference between the feedback signal and a predetermined threshold, or a sum of the feedback signal and a predetermined threshold.

According to a second aspect of the present disclosure, an LED driving circuit is provided, including:

the current source circuit according to the first aspect, and a driving circuit;

where the driving circuit receives an input voltage and converts the input voltage to an output voltage to drive an LED serving as a load, and the current source circuit is connected in series with the LED serving as the load, to provide the driving current flowing through the LED serving as the load.

According to the technical solution of the embodiment of the present disclosure, the current at the output terminal of the operational transconductance amplifier is shunted based on the first control signal that includes the duty cycle information, or the input signal at least one input terminal of the operational transconductance amplifier is controlled to be switched between different voltage signals based on the first control signal, so as to adjust the output current of the current adjustment circuit. The driving voltage for driving the current generation circuit is adjusted based on the output current, so that the driving current generated by the current source circuit is correlated with the duty cycle information. None of an amplitude modulation circuit, a low pass filter and the like for processing the first control signal is used, thereby effectively simplifying circuit design and improving system efficiency.

BRIEF DESCRIPTION OF THE DRAWINGS

Hereinafter embodiments of the present disclosure is described in conjunction with drawings, to make the aforementioned and other objectives, characteristics and advantages of the present disclosure clearer. The drawings are as follows.

DETAILED DESCRIPTION

Figure 1:
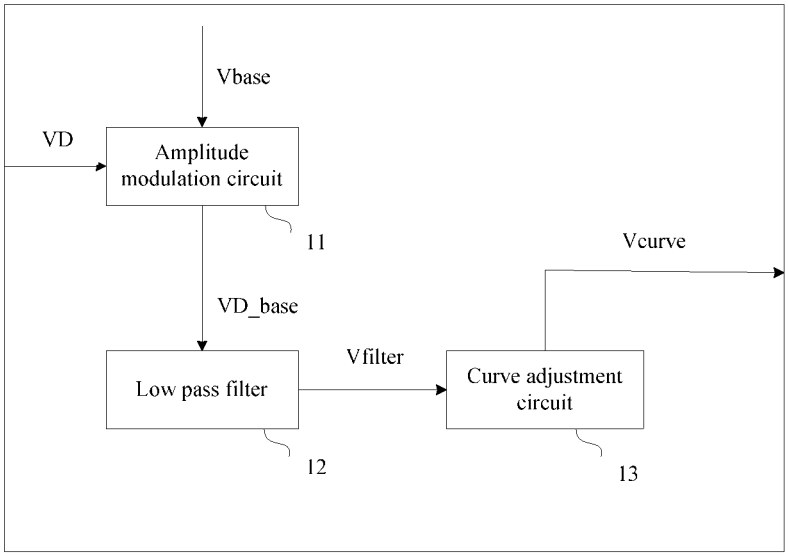
FIG. 1 is a circuit for adjusting a voltage curve in conventional technology.
Figure 2:
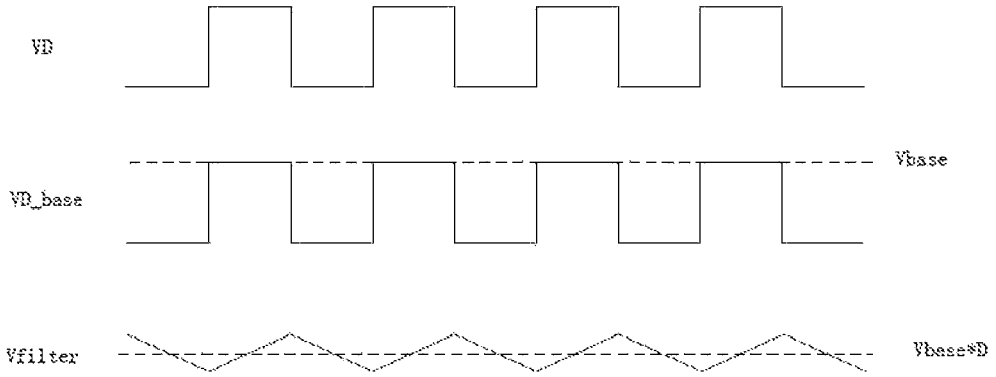
FIG. 2 is a waveform diagram in operation of a circuit for adjusting a voltage curve in conventional technology.
Figure 3:
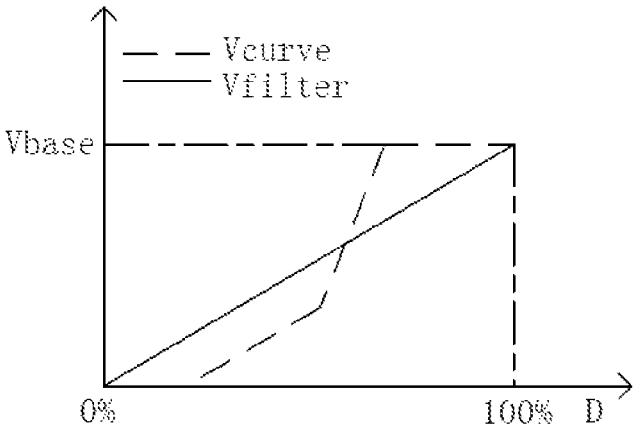
FIG. 3 is a voltage function of a circuit for adjusting a voltage curve in conventional technology.

Embodiments of the present disclosure are described hereinafter. The present disclosure is not limited by the described embodiments. Hereinafter specific detailed parts are fully described in the description of the present disclosure. Those skilled in the art may thoroughly understand the present disclosure without such specific detailed parts. Methods, processes, elements and circuits that are well known by those skilled in the art are not fully described to prevent confusing substantial contents of the present disclosure.

In addition, those skilled in the art should appreciate that the provided drawings are for illustration, and dimensions shown in the drawings may not be drawn to scale.

In addition, it should be appreciated that the wording "circuit" in following description may refer to a conductive loop formed by at least one element or sub-circuit connected electrically or electromagnetically. In a case that an element or a circuit is referred to "connect" to another element or an element/circuit is referred to be "connected" between two nodes, it may be directly coupled or connected to another element, or there may be an intermediate element. Connections between elements may refer to a physical connection, a logical connection, or a combination of the physical connection and the logical connection. In a case that an element is referred to be "directly coupled" or "directly connected" with another element, it means that there is no intermediate element connected between them.

Unless explicitly defined otherwise in context, the terms "include", "comprise" or other similar terms in the whole specification and claims should be interpreted to be inclusive instead of being exclusive or exhaustive. Namely, they should be interpreted to be "including but not being limited to".

It should be appreciated in the description of the present disclosure that the terms "first" and "second" in the descriptions are merely for description, and should not be interpreted as indication or implication of relative importance. In addition, unless defined otherwise, the term "multiple" refers to a quantity of two or more than two in the description of the present disclosure.

Figure 4:
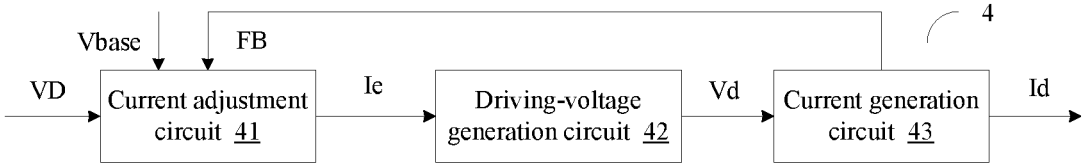
FIG. 4 is a block diagram of a current source circuit according to an embodiment of the present disclosure.

FIG. 4 is a block diagram of a current source circuit according to an embodiment of the present disclosure. As shown in FIG. 4, the current source circuit 4 in the embodiment includes a current adjustment circuit 41. The current adjustment circuit 41 receives a first control signal VD, a feedback signal FB characterizing a driving current, and a referential voltage signal Vbase determined by a parameter of the current source circuit, so as to generate an output current Ie. According to various different implementations, the first control signal VD includes duty cycle information, and may be, for example, a pulse width modulation (PWM) signal, a PWM dimming signal, and the like. The current adjustment circuit 41 provides the output current Ie to a driving-voltage generation circuit 42, based on the first control signal VD. The driving-voltage generation circuit 42 generates a corresponding driving voltage Vd for driving a current generation circuit 43. The current generation circuit 43 generates the driving current $I_D$ correlated with the duty cycle information, and outputs the feedback signal FB characterizing the driving current $I_D$. The current source circuit in this embodiment controls, via a closed loop feedback, the driving current ID to change with the first control signal VD.

In the embodiment, the current adjustment circuit 41 includes an operational transconductance amplifier. The current adjustment circuit 41 adjusts an input signal at an input terminal of the operational transconductance amplifier based on the first control signal VD, so as to adjust the output current Ie. Specifically, the first control signal VD is switched between a first state and a second state. A current at an output terminal of the operational transconductance amplifier is shunted, or an input signal at at least one input terminal of the operational transconductance amplifier is controlled to be switched between different signals based on different states of the first control signal VD. Thereby, the output current Ie is adjusted, and linear control of the feedback signal FB is achieved, such that the driving current ID generated by the current source circuit 4 is correlated with the duty cycle information. In one implementation, the first control signal $V_D$ is a PWM dimming signal, the duty cycle information is a duty cycle D of the PWM dimming signal, and the current source circuit 4 generates the driving current ID correlated with the duty cycle D based on the PWM dimming signal. The driving current ID may be configured to provide energy to a light source, and for example, the light source may be a light emitting diode or the like.

Compared with the technical solution shown in FIG. 1, the aforementioned current source circuit can adjust the driving voltage of the current generation circuit via the closed-loop feedback and correlate the driving current with the duty cycle information, without a low pass filter, a curve adjustment circuit or the like.

Figure 5:
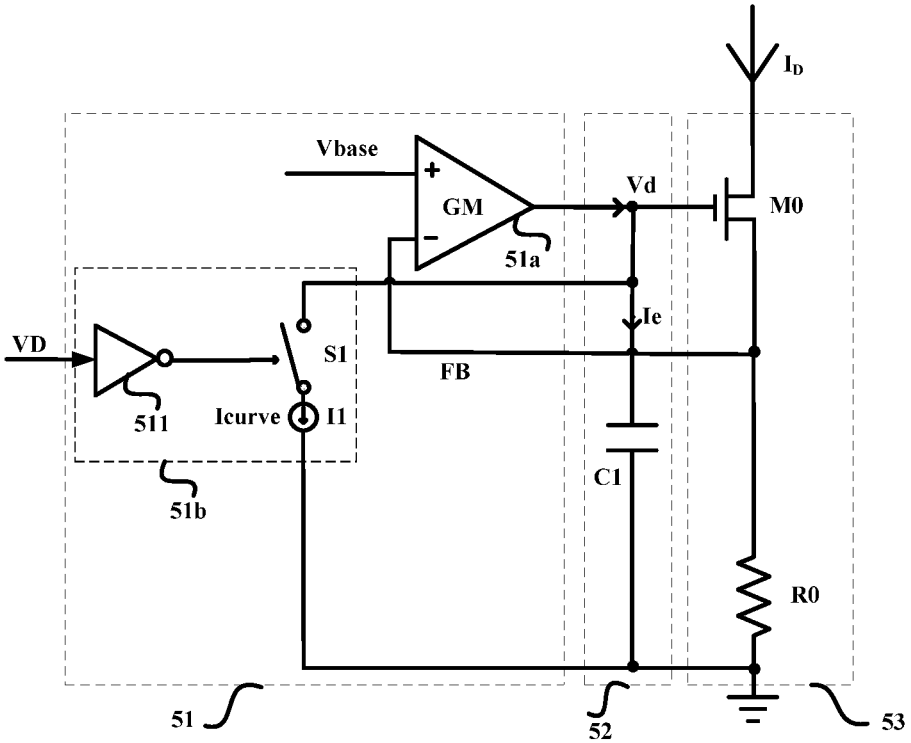
FIG. 5 is a circuit diagram of a current source according to a first embodiment of the present disclosure.

FIG. 5 is a circuit diagram of the current source circuit according to the first embodiment of the present disclosure. The current source circuit includes a current adjustment circuit 51, a driving-voltage generation circuit 52, and a current generation circuit 53. The current adjustment circuit 51 includes an operational transconductance amplifier 51*a*. A first input terminal (e.g., a non-inverting input terminal) of the operational transconductance amplifier 51*a* receives a referential voltage signal Vbase, which is determined by a parameter of the current source circuit. A second input terminal (e.g., an inverting input terminal) receives a feedback signal FB characterizing the driving current $I_D$. The output current Ie is generated at an output terminal of the operational transconductance amplifier 51*a* by comparing the referential voltage signal Vbase with the feedback signal FB. The driving-voltage generation circuit 52 includes a capacitor C1, configured to filter the output current Ie to generate a driving voltage Vd. The current generation circuit 53 includes a transistor M0 and a sampling resistor R0 that are connected in series. The transistor M0 includes a control terminal for receiving the driving voltage Vd, a first power terminal, and a second power transistor grounded via the sampling resistor R0. The transistor M0 generates, based on the driving voltage Vd, the driving current ID that flows through the first power terminal and the second power terminal. The sampling resistor R0 includes a first terminal connected to the second power terminal of the transistor M0 and a second terminal connected to the ground. The feedback signal FB characterizing the driving current ID flowing through the transistor M0 is generated at the first terminal of the sampling resistor R0. The current adjustment circuit 51 adjusts the current at the output terminal of the operational transconductance amplifier 51*a* based on the first control signal VD that includes the duty cycle information. Thereby, the output current Ie of the current adjustment circuit 51 is adjusted to change the driving voltage Vd for controlling the transistor M0, so that the driving current ID generated by the current generation circuit 53 is correlated with the duty cycle information. Specifically, the first control signal VD is switched between two states. In a case that the first control signal VD is in a first state, the output current Ie of the current adjustment circuit 51 is the current at the output terminal of the operational transconductance amplifier 51*a*. In a case that the first control signal VD is in a second state, the output current Ie of the current adjustment circuit 51 is smaller than the current at the output terminal of the operational transconductance amplifier 51*a*. It should be understood that the transistor in the embodiment may be any type of field effect transistors, such as a metal-oxide semiconductor field effect transistor.

The current adjustment circuit 51 further includes a shunt circuit 51*b*. The shunt circuit 51*b* receives the first control signal VD, and shunts the output current of the operational transconductance amplifier 51*a* based on the first control signal VD, so as to adjust the output current Ie of the current adjustment circuit 51. The shunt circuit 51*b* includes a NOT gate 511, a controllable switch S1 and a current source I1. The first control signal VD is inverted by the NOT gate 511 and inputted to a control terminal of the controllable switch S1, so as to control the controllable switch S1 to be switched between on and off. The controllable switch S1 further includes a first terminal coupled to the output terminal of the operational transconductance amplifier 51*a*, and a second terminal connected to the ground through via current source I1. The series-connected current source I1 and switch S1 are connected to the output terminal of the operational transconductance amplifier 51*a* and connected in parallel with the capacitor C1.

In the embodiment, the first control signal VD is switched between the first state and the second state. In a case that the first control signal VD is in the first state, the controllable switch S1 is off, the current source I1 is disconnected from the output terminal of the operational transconductance amplifier 51*a*, and an current received by the driving-voltage generation circuit 52 is equal to the current at the output terminal of the operational transconductance amplifier 51*a*. In a case that the first control signal VD is in the second state, the controllable switch S1 is on, the current source I1 is connected to the output terminal of the operational transconductance amplifier 51*a*. A first portion of the current at the output terminal of the operational transconductance amplifier 51*a* is shunted by the current source I1, and a second portion that is remained serves as the output current Ie of the current adjustment circuit 51. Therefore, different duty cycles of the first control signal VD can be used to control the shunt circuit 51*b* to shunt the first portion of the current at the output terminal of the operational transconductance amplifier 51*a* for different lengths of time, so as to adjust the output current Ie. The driving-voltage generation circuit 52 generates, based on the output current Ie, the driving voltage Vd correlated with the duty cycle information, and the current generation circuit 53 correlates the driving current $I_D$ flowing through the transistor M0 with the duty cycle information of the first control signal VD via the closed-loop feedback control. In a case that the first control signal VD is switched between the first state and the second state, the feedback signal FB changes with the driving current ID, such that the feedback signal FB is linear with the duty cycle D.

In the embodiment, the first control signal VD may be a PWM dimming signal, and the duty cycle D of the PWM dimming signal is the duty cycle information. It is taken as an example for illustration that a high level of the PWM dimming signal serves as the first state, and a low level serves as the second state. In a case that the PWM dimming signal is at the high level, the shunt circuit 51*b* is not active, and the current at the output terminal of the operational transconductance amplifier 51*a* is the output current Ie. In a case that the PWM dimming signal is at the low level, the shunt circuit 51*b* shunts the first portion of the current at the output terminal of the operational transconductance amplifier 51*a*. A current Icurve flows through the current source I1, and the driving-voltage generation circuit 52 filters a residual current Ie to generate the driving voltage Vd. Thereby, the driving current ID is correlated with the duty cycle D of the first control signal VD. Therefore, the current at the output terminal of the operational transconductance amplifier 51*a* can be shunted for different lengths of time, based on an effective duration of the high level of the PWM dimming signal, so as to adjust the output current Ie of the current adjustment circuit 51.

In a case that the operational transconductance amplifier 51*a* operates in a steady state via the closed loop feedback control, a following equation can be obtained from conservation of charge variation of the operational transconductance amplifier 51*a* in one switching period.

$$(V\text{base}-\text{FB})GM\times Ts=(1-D)I\text{curve}\times Ts \tag{1}$$

The feedback signal FB is expressed by equation (2), which can be derived from equation (1).

$$FB=\frac{Icurve}{GM}D+Vbase-\frac{Icurve}{GM} \tag{2}$$

GM is a transconductance of the operational transconductance amplifier 51*a*. Ts is a period of the first control signal VD. D is the duty cycle of the first control signal VD. Icurve is a current of the current source I1. Vbase is the referential voltage signal.

Figure 6:
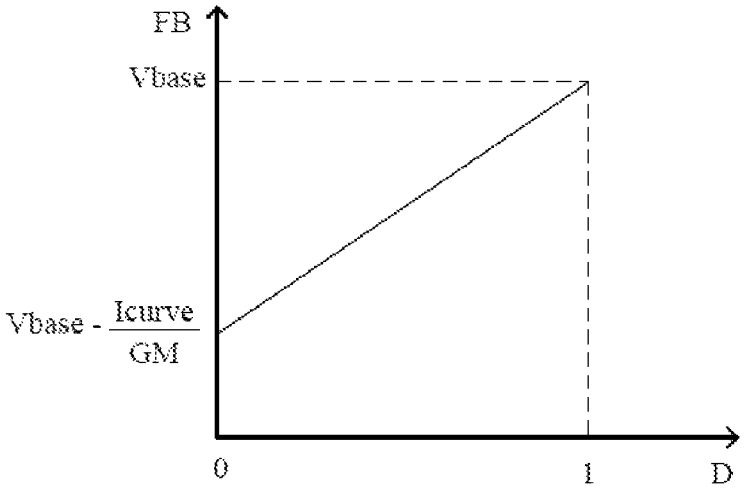
FIG. 6 is a voltage function of a current source according to a first embodiment of the present disclosure.

FIG. 6 is a voltage function of the current source circuit according to the first embodiment of the present disclosure.

It can be seen from the equation (2) that the first control signal VD is linear with the duty cycle D of the feedback signal FB. In a case that the duty cycle D is zero, an initial feedback signal FB is $$Vbase-\frac{Icurve}{GM}.$$

In a case that the duty cycle D is less than 1, the feedback signal FB is linear with the duty cycle D, and an increasing slope is $$\frac{Icurve}{GM}.$$

In a case that the duty cycle D is 1, the feedback signal FB reaches maximum. In such case, the corresponding driving current ID flowing through the transistor M0 reaches a maximum of Vbase/R0.

It should be understood that the feedback signal FB corresponding to the zero duty cycle equal can be different by adjusting the referential voltage signal Vbase, the current Icurve of the current source I1, and the transconductance GM of the operational transconductance amplifier 51*a*. Namely, the initial feedback signal FB is different, and the increasing slope of the feedback signal FB with respect to the duty cycle D is changed.

Figure 7:
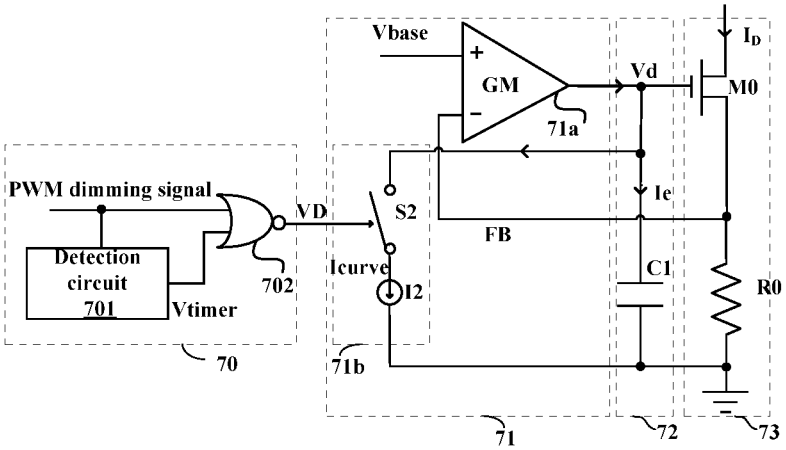
FIG. 7 is a circuit diagram of a current source according to a second embodiment of the present disclosure.

FIG. 7 is a circuit diagram of a current source circuit according to a second embodiment of the present disclosure. The second embodiment is different from the first embodiment in that the current adjustment circuit 71 adjusts the output current Ie in multiple segments based on the duty cycle information of the first control signal VD, so as to achieve the segmental control of the feedback signal FB. Thereby, the driving current ID is correlated with the duty cycle information of the first control signal. The driving-voltage generation circuit 72 and the current generation circuit 73 are same as those in the first embodiment, and hence are not further described herein.

In the embodiment, the current source circuit further includes a first-control-signal generation circuit 70. The current adjustment circuit 71 includes an operational transconductance amplifier 71*a* and a shunt circuit 71*b*. The first-control-signal generation circuit 70 includes a detection circuit 701 and a NOR gate 702. The detection circuit 701 receives a PWM dimming signal and detects a duty cycle D of the PWM dimming signal. In a case that the duty cycle D of the PWM dimming signal is less than a preset value, a detection signal Vtimer outputted by the detection circuit 701 is active and at a low level. The PWM dimming signal and the detection signal Vtimer are both inputted to the NOR gate 702. In a case the PWM dimming signal and the detection signal Vtimer are both active and at a low level, the NOR gate 702 outputs the first control signal VD at a high level. The shunt circuit 71*b* includes a controllable switch S2 and a current source 12 that are connected in series. A first terminal of the controllable switch S2 is connected to an output terminal of the operational transconductance amplifier 71*a*, and a second terminal of the controllable switch S2 is connected to a positive terminal of the current source 12. A negative terminal of the current source 12 is connected to the ground. The controllable switch S1 is controlled to be switched between on and off by the first control signal VD.

In the embodiment, the first control signal VD is switched between a first state and a second state. It is taken as an example for illustration that a low level of the first control signal VD serves as the first state, and the high level of the first control signal VD serves as the second state. In a case that the duty cycle D of the PWM dimming signal is greater than the preset value, the detection signal Vtimer outputted by the detection circuit 701 is at a high level. Thereby, the first control signal VD is in the first state, namely, the first control signal VD is kept at the low level, and the shunt circuit 71*b* is not active. The current at the output terminal of the operational transconductance amplifier 71*a* is the output current Ie. According to the principle of "virtual-short" in the amplifier, voltages at the input terminals of the operational transconductance amplifier 71*a* are equal. Namely, the feedback signal FB is kept equal to the referential signal Vbase, and the driving current ID generated by the current generation circuit 73 is constant and maintained at Vbase/R0.

In a case that the duty cycle of the PWM dimming signal is less than the preset value, the detection circuit 701 starts timing when the PWM dimming signal is switched from the high level to the low level, and the detection signal Vtimer that is active and at the low level is outputted when the timed duration reaches a timing reference Tdelay. In a case that the PWM dimming signal and the detection signal Vtimer are both active and at the low level, the first control signal VD is switched from the first state to the second state. Namely, the first control signal VD is switched from the low level to the high level. The shunt circuit 71*b* shunts the current at the output terminal of the operational transconductance amplifier 71*a* during the first control signal VD is at the high level, until the next period when the PWM dimming signal comes. The first control signal VD is switched between the first state and the second state, and the feedback signal FB changes with the driving current ID, so that the feedback signal FB is linear with the duty cycle D. Equation (3) can be obtained according to conservation of charge variation of the operational transconductance amplifier in one period.

$$(Vbase - FB)GM \times Ts = \left(1 - D - \frac{Tdelay}{Ts}\right) Icurve \times Ts \tag{3}$$

The feedback signal FB can be expressed by equation (4), which is derived from the equation (3).

$$FB = \frac{Icurve}{GM}\left(D + \frac{Tdelay}{Ts}\right) + Vbase - \frac{Icurve}{GM} \tag{4}$$

GM is the transconductance of the operational transconductance amplifier 71*a*. Ts is the period of the PWM dimming signal. Tdelay is the timing reference. D is the duty cycle of the PWM dimming signal. Icurve is the current of the current source 12. Vbase is the referential voltage signal.

Figure 8A:
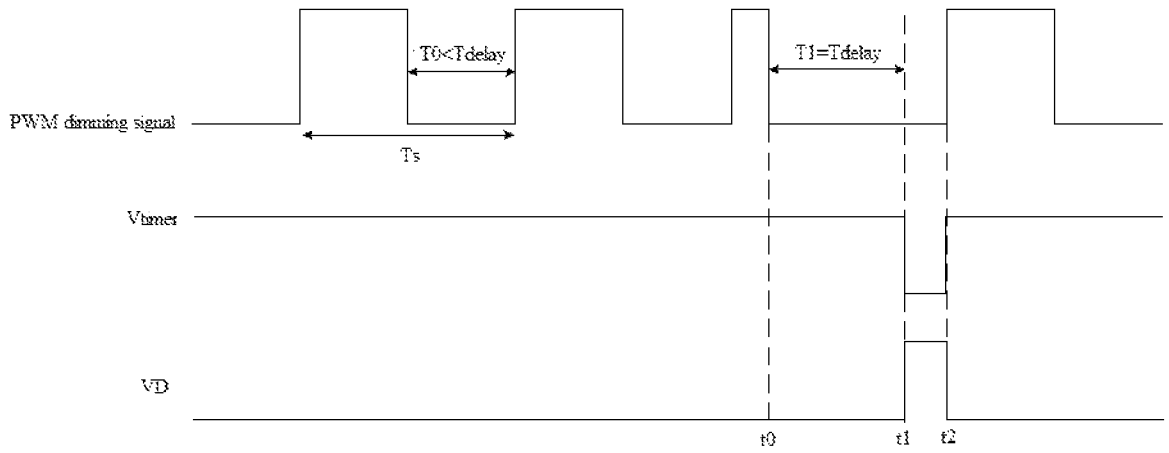
FIG. 8*a* is a waveform diagram in operation of a current source according to a second embodiment of the present disclosure.

FIG. 8*a* is a waveform diagram in operation of the current source circuit according to the second embodiment of the present disclosure. Before moment t0, the duty cycle of the PWM dimming signal is greater than the preset value, the detection circuit 701 times duration of the low level time length of the PWM dimming signal, and the timed duration T0 is less than the timing reference Tdelay. Thereby, the detection signal Vtimer is always kept at the high level, and the first control signal VD is kept in the first state, that is, kept at the low level. The shunt circuit 71*b* is not active.

At moment t0, the duty cycle D of the PWM dimming signal is less than the preset value, and the detection circuit starts timing when the PWM dimming signal is switched from the high level to the low level. At moment t1, the timed duration T1 is equal to the timing reference Tdelay, and the detection circuit 701 generates the detection signal Vtimer that is active and at the low level. NOR operation is performed between the detection signal Vtimer and the PWM dimming signal, to generate the first control signal VD that is active and at the high level. Namely, the first control signal VD is switched from the first state to the second state, and the shunt circuit 71*b* starts being active. At moment t2, the PWM dimming signal comes in a next period, the detection signal Vtimer jumps to the high level, the first control signal VD jumps to the low level, and the shunt circuit 71*b* stops being active. The detection circuit 701 detects the duty cycle of the PWM dimming signal again. In a case that the duty cycle of the PWM dimming signal is less than the preset value, the first control signal VD that is active and at the high level is generated again, and the process is repeated.

Figure 8B:
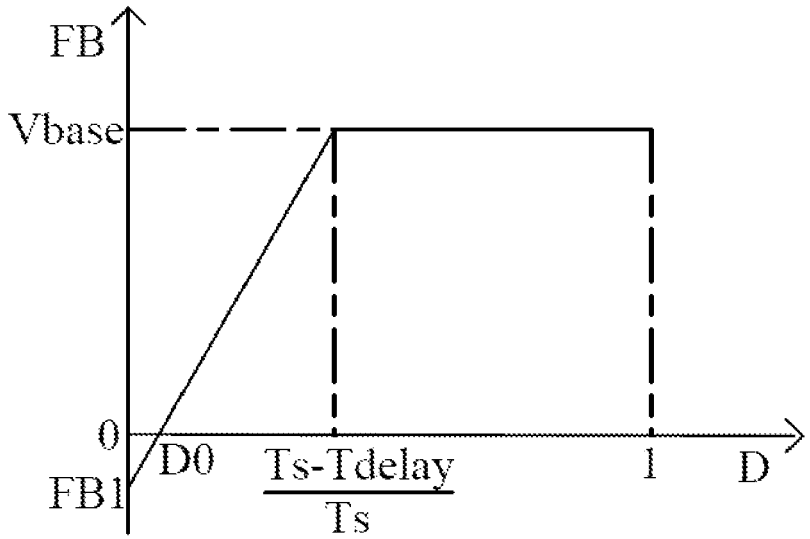
FIG. 8*b* is a voltage function of a current source according to a second embodiment of the present disclosure.

FIG. 8*b* is a voltage function of a current source according to the second embodiment of the present disclosure. The function relationship between the feedback signal FB and the duty cycle D can be obtained by the equation (4). In a case that the duty cycle D is less than DO, the feedback signal FB is negative, and the current source circuit in the embodiment does not operate. In practice, the current source circuit in the embodiment may change the initial value FB1 of the feedback signal, by adjusting parameters in the equation (4) according to actual requirements. Thereby, the value of DO is changed, so that the current source circuit does not operate in a case the duty cycle D is small. In a case that the duty cycle D is greater than DO and less than the preset value $$\frac{Ts - Tdelay}{Ts},$$

the feedback signal FB increases linearly with the increasing duty cycle D, further indicating that the driving current ID generated by the current source circuit is increasing. In a case that the duty cycle D reaches the preset value $$\frac{Ts - Tdelay}{Ts},$$

the feedback signal FB is kept to be equal to the referential voltage signal Vbase, and the driving current ID reaches a maximum of Vbase/R0. It should be understood that the timing reference Tdelay and the period Ts of the PWM dimming signal may be adjusted according to a practical requirement, so as to change the preset value $$\frac{Ts - Tdelay}{Ts},$$

thereby changing an inflection point between the linear portion and the constant portion of the feedback signal FB. It should be understood that multiple different preset values may be included in another embodiment, and the feedback signal is controlled to be varied in different slops during different phases of the duty cycle D, so that the feedback signal FB corresponds to different inflection points when the duty cycle reaches different preset values. Thereby, control of the feedback signal FB is implemented in multiple segments.

Figure 9:
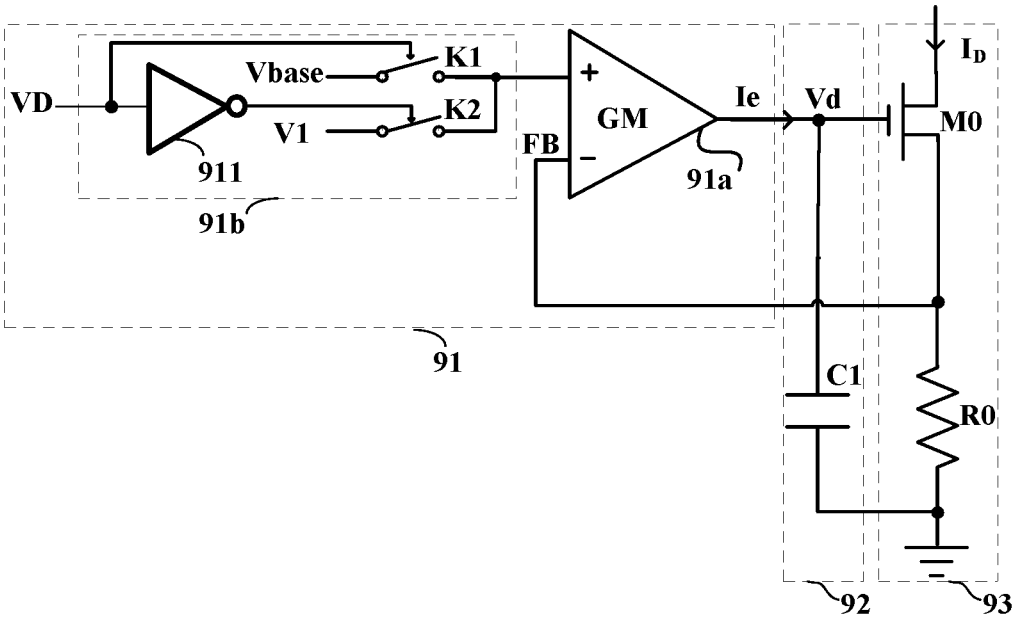
FIG. 9 is a circuit diagram of a current source according to a third embodiment of the present disclosure.

FIG. 9 is a circuit diagram of a current source circuit according to a third embodiment of the present disclosure. A difference from the first embodiment lies in that the current adjustment circuit 91 directly switches a first input signal at the first input terminal of the operational transconductance amplifier 91*a*, based on the first control signal VD, so as to adjust the current at the output terminal of the operational transconductance amplifier 91*a*. Thereby, linear control of the feedback signal FB is achieved, such that the driving current ID is correlated with the duty cycle information of the first control signal VD. The driving-voltage generation circuit 92 and the current generation circuit 93 are same as those in the above embodiments, and hence are not further described herein.

The current adjustment circuit 91 includes an operational transconductance amplifier 91*a* and a switch circuit 91*b*. The switch circuit 91*b* includes an inverter 911, a first switch K1 and a second switch K2. The first switch K1 includes a first terminal receiving referential voltage signal Vbase and a second terminal connected to the first input terminal (e.g., the non-inverting input terminal) of the operational transconductance amplifier 91*a*. A control terminal of the first switch K1 receives a first control signal VD. The second switch K2 includes a first terminal receiving a first voltage signal V1 and a second terminal connected to the second terminal of the first switch K1. A control terminal of the second switch K2 receives the phase-inverted first control signal VD via the inverter 911. A second input terminal (e.g., an inverting input terminal) of the operational transconductance amplifier 91*a* receives a feedback signal FB characterizing a driving current ID, so as to generate an output current Ie.

In the embodiment, the first control signal VD is switched between a first state and a second state. In a case that the first control signal VD is in the first state, the first input signal of the operational transconductance amplifier 91*a* is the first voltage signal V1. In a case that the first control signal VD is in the second state, the first input signal of the operational transconductance amplifier 901 is the referential voltage signal Vbase. Thereby, a voltage difference between the input signals at the input terminals of the operational transconductance amplifier 901 is changed, thereby adjusting the output current Ie.

In an embodiment, the first control signal VD is a PWM dimming signal, and the duty cycle information is a duty cycle D of the PWM dimming signal. In a case that the PWM dimming signal is at a low level, namely, the first control signal VD is in the first state, the first switch K1 is off, the second switch K2 is on, and the first input signal is the first voltage signal V1. In a case that the PWM dimming signal is at a high level, namely, the first control signal VD is in the second state, the first switch K1 is on, the second switch K2 is off, and the first input signal is the referential voltage signal Vbase. In a case that the operational transconductance amplifier 91*a* operates in a closed loop, it is known from the input-output characteristics that the feedback signal FB can be expressed by equation (5).

$$FB = V1(1-D) + DVbase \tag{5}$$

D is the duty cycle of the first control signal VD. Vbase is the referential voltage signal. V1 is the first voltage signal. It can be seen from equation (5) that the feedback signal FB is linear with the duty cycle D. In a case that the duty cycle is equal to 0, an initial feedback signal FB is V1. In a case that the duty cycle D is less than 1, the feedback signal FB is linear with the duty cycle D, and an increasing slope is Vbase−V1. In a case that the duty cycle is equal to 1, the feedback signal FB is equal to the referential voltage signal Vbase. In the embodiment, the function same as the current source circuit in the second embodiment is achieved by switching the first input signal at the first input terminal of the operational transconductance amplifier, except that the increasing slope of the feedback signal FB with respect to the duty cycle D is different, and the initial value of the feedback signal FB is different.

In an embodiment, referring to the current adjustment circuit described in FIG. 9, the first voltage signal may be selected to be 0V, and the referential voltage signal Vbase may be selected to be 300 mv. In such case, the driving current ID flowing through the transistor M0 correspondingly reaches maximum and is equal to Vbase/R0. It should be understood that the above numerical values are merely provided as an example, and different voltages may be selected to meet specific design requirements in different application environments.

Figure 10:
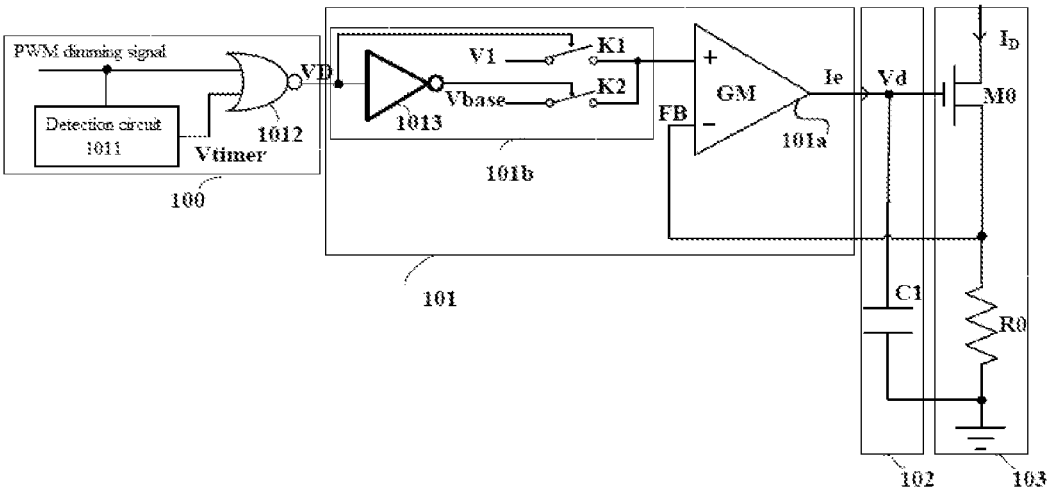
FIG. 10 is a circuit diagram of a current source according to a fourth embodiment of the present disclosure.

FIG. 10 is a circuit diagram of a current source circuit according to a fourth embodiment of the present disclosure. The current source circuit in the embodiment is different from the third embodiment in that the current adjustment circuit 101 adjusts the output current Ie in segments, by switching the first input signal at the first input terminal of an operational transconductance amplifier 101*a* based on the first control signal VD, so as to achieve segmental control of the feedback signal FB. Thereby, the driving current ID is correlated with the duty cycle information of the first control signal VD.

The current source circuit in the embodiment includes a first-control-signal generation circuit 100. The current adjustment circuit 101 includes the operational transconductance amplifier 101*a* and a switch circuit 101*b*. The first-control-signal generation circuit 100 includes a detection circuit 1011 and a NOR gate 1012. The first-control-signal generation circuit 100 in the embodiment is same as the first-control-signal generation circuit in the second embodiment. The detection circuit 1011 receives the PWM dimming signal and detects the duty cycle D of the PWM dimming signal. In a case that the duty cycle D of the PWM dimming signal is less than a preset value, the detection signal Vtimer outputted by the detection circuit 1011 is active and at a low level. In a case that the PWM dimming signal and the detection signal Vtimer are both active and at a low level, the NOR gate 1012 outputs the first control signal VD at a high level. The switch circuit 101*b* includes an inverter 1013, a first switch K1 and a second switch K2. The switch circuit 101*b* and the operational transconductance amplifier 101*a* in the embodiment are constructed and connected in the same manner as the third embodiment. The driving-voltage generation circuit 102 and the current generation circuit 103 are same as those in the above embodiments, and hence are not further described herein.

In the embodiment, the first control signal VD is switched between a first state and a second state. It is taken as an example for illustration that the low level of the first control signal VD serves as the first state, and a high level of the first control signal VD serves as the second state. In a case that the duty cycle D of the PWM dimming signal is greater than the preset value, the detection signal Vtimer outputted by the detection circuit 1011 is at a high level. Thereby, the first control signal VD is in the first state, namely, kept at the low level. The first switch K1 is off, the second switch K2 is on, the first input signal of the operational transconductance amplifier 101*a* is the referential voltage signal Vbase, and the second input signal is FB. According to the principle of "visual short" in the amplifier, voltages at the input terminals of the operational transconductance amplifier 101*a* are equal. Namely, the feedback signal FB is kept equal to the referential voltage signal Vbase, and the driving current ID generated by the current generation circuit 103 is constant and maintained at Vbase/R0.

In a case that the duty cycle of the PWM dimming signal is less than the preset value, the detection circuit 1011 starts timing when the PWM dimming signal is switched from the high level to the low level, and the detection signal Vtimer that is active and at the low level is outputted when the timed duration reaches the timing reference Tdelay. In a case that the PWM dimming signal and the detection signal Vtimer are both active and at the low level, the first control signal VD is switched from the first state to the second state, that is, the first control signal VD is switched from the low level to the high level. The first switch K1 is on and the second switch K2 is off. The first input signal of the operational transconductance amplifier 101*a* is the first voltage V1, until a next period when the PWM dimming signal comes. In a case that the duty cycle of the PWM dimming signal is less than the preset value, the first control signal VD is switched between the first state and the second state, and a voltage difference is generated between the input signals at the input terminals of the operational transconductance amplifier 101*a*. Thereby, the current generated at the output terminal of the operational transconductance amplifier 101*a* is changed, such that the feedback signal FB is linear with the duty cycle D. In a case that the operational transconductance amplifier operates in a closed loop, it can be known from the input-output characteristics that the feedback signal FB may be expressed by equation (6).

$$FB = Vbase\left(D + \frac{Tdelay}{Ts}\right) + \left(1 - D - \frac{Tdelay}{Ts}\right)V1 \tag{6}$$

D is the duty cycle of the PWM dimming signal. Vbase is the referential voltage signal. V1 is the first voltage signal. Tdelay is the timing reference. Ts is the period of the PWM dimming signal. In a case that the duty cycle D is smaller than the preset value $$\frac{Ts - Tdelay}{Ts},$$

the feedback signal FB is linear with the duty cycle D. The feedback signal FB increases as the duty cycle D increases, and the driving current also increases. In a case that the duty cycle reaches the preset value $$\frac{Ts - Tdelay}{Ts},$$

the feedback signal FB is kept equal to the referential voltage signal Vbase, and the driving current reaches a maximum of Vbase/R0. In the embodiment, the function same as the current source circuit in the second embodiment can be realized, by including the first-control-signal generation circuit 101*b* in the current adjustment circuit 101 to switch the first input signal at the first input terminal of the operational transconductance amplifier. The segmental control of the feedback signal FB is achieved, and the feedback signal FB increases linearly and then keeps constant with the increasing duty cycle D.

In an embodiment, referring to the current adjustment circuit described in FIG. 10, the first voltage signal may be selected to be 0V, and the referential voltage signal Vbase may be selected to be 300 mV. It should be understood that the above values are merely provided as an example, and different voltage values may be selected to meet specific design requirements in different application environments.

Figure 11:
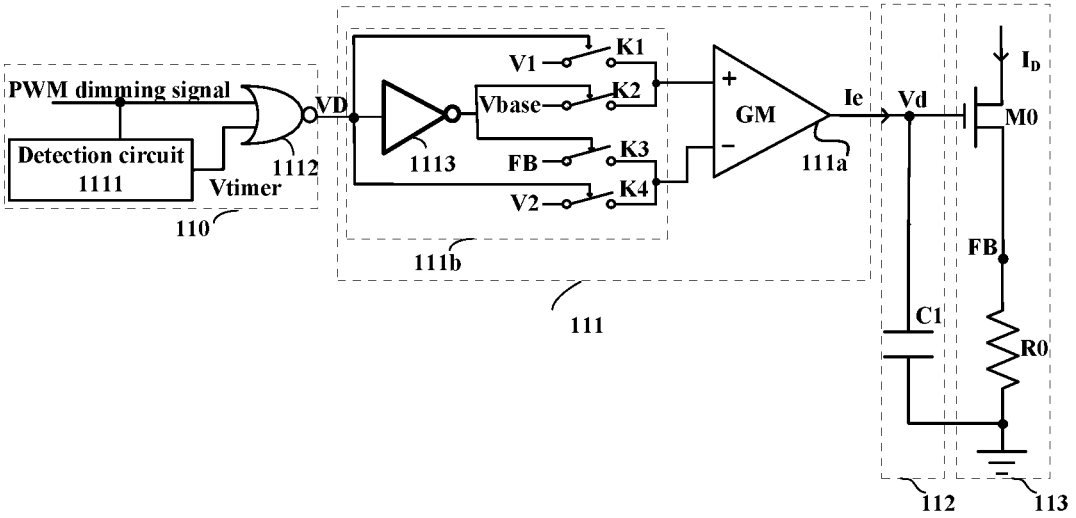
FIG. 11 is a circuit diagram of a current source according to a fifth embodiment of the present disclosure.

FIG. 11 is a circuit diagram of a current source circuit according to a fifth embodiment of the present disclosure. The current source circuit in the embodiment is different from the fourth embodiment in that the current adjustment circuit 111 simultaneously switches, based on the first control signal VD, the first input signal at the first input terminal of the operational transconductance amplifier 111*a* and the second input voltage signal at the second input terminal of the operational transconductance amplifier 111*a*, so as to adjust the output current Ie in segments. The segmental control of the feedback signal FB is achieved. Thereby, the driving current ID is correlated with the duty cycle information of the first control signal.

The current source circuit includes a first-control-signal generation circuit 110. The current adjustment circuit 111 includes an operational transconductance amplifier 111*a* and a switch circuit 111*b*. The first-control-signal generation circuit 110 includes a detection circuit 1111 and a NOR gate 1112. The first-control-signal generation circuit 110 in the embodiment is same as the first-control-signal generation circuit in the second embodiment and the fourth embodiment, and hence is not further described herein. The switch circuit 111*b* includes an inverter 1113, a first switch K1, a second switch K2, a third switch K3, and a fourth switch K4. The first switch K1 includes a first terminal receiving a first voltage signal V1, and a second terminal connected to a first input terminal (e.g., a non-inverting input terminal) of the operational transconductance amplifier 111*a*. A control terminal of the first switch K1 receives the first control signal VD. The second switch K2 includes a first terminal receiving a referential voltage signal Vbase, and a second terminal connected to the second terminal of the first switch K1. A control terminal of the second switch K2 receives the phase-inverted first control signal VD via the inverter 1113. The third switch K3 includes a first terminal receiving the feedback signal FB, and a second terminal connected to the second input terminal (e.g., an inverting input terminal) of the operational transconductance amplifier 111*a*. A control terminal of the third switch K3 receives the phase-inverted first control signal VD via the inverter 1113. The fourth switch K4 includes a first terminal receiving a second voltage signal V2, and a second terminal connected to the second terminal of the third switch K3. A control terminal of the fourth switch K4 receives the first control signal VD.

In the embodiment, the first control signal VD is switched between a first state and a second state. It is taken as an example for illustration that a low level of the first control signal VD serves as the first state, and a high level of the first control signal VD serves as the second state. In a case that the duty cycle D of the PWM dimming signal is greater than a preset value, the detection signal Vtimer outputted by the detection circuit 1111 is at a high level, so that the first control signal VD is in the first state, that is, kept at the low level. The first switch K1 is off, the second switch K2 is on, and the first input signal of the operational transconductance amplifier 111*a* is the referential signal Vbase. The third switch K3 is on, the fourth switch K4 is off, and the second input signal of the operational transconductance amplifier 111*a* is the feedback signal FB. According to the principle of "virtual-short" in the amplifier, voltages at the input terminals of the operational transconductance amplifier 111*a* are equal. Namely, the feedback signal FB is kept equal to the referential signal Vbase, and the driving current ID generated by the current generation circuit is constant and maintained at Vbase/R0.

In a case that the duty cycle of the PWM dimming signal is less than the preset value, the detection circuit 1111 starts timing when the PWM dimming signal is switched from a high level to a low level, and the detection signal Vtimer that is active and at a low level is outputted when the timed duration reaches a timing reference Tdelay. In a case that the PWM dimming signal and the detection signal Vtimer are both active and at the low level, the first control signal VD is switched from the first state to the second state, that is, the first control signal VD is switched from the low level to the high level. The first switch K1 is on, the second switch K2 is off, and the first input signal of the operational transconductance amplifier 111*a* is the first voltage V1. The third switch K3 is off, the fourth switch K4 is on, and the second input signal of the operational transconductance amplifier 111*a* is the second voltage V2, until a next period of the PWM dimming signal comes. In the case that the duty cycle of the PWM dimming signal is less than the preset value, the first control signal VD is switched between the first state and the second state, such that the feedback signal FB is linear with the duty cycle D of the PWM dimming signal. In an embodiment, the first voltage signal V1 is 0V, and the second voltage signal V2 may be a sum of the feedback signal FB and a preset threshold Vth. In a case that the operational transconductance amplifier operates in a closed loop, it can be known from the input-output characteristic that the feedback signal FB may be expressed by the equation (7).

$$FB + \left(1 - D - \frac{Tdelay}{Ts}\right)Vth = Vbase\left(D + \frac{Tdelay}{Ts}\right) \tag{7}$$

D is the duty cycle of the PWM dimming signal. Vbase is the referential voltage signal. Tdelay is the timing reference. Ts is the period of the PWM dimming signal. In a case that the duty cycle D is smaller than the preset value $$\frac{Ts - Tdelay}{Ts},$$

the feedback signal FB linearly increases with the increasing duty cycle D, and it is indicated that the driving current generated by the current source circuit is increasing. In a case that the duty cycle signal reaches the preset value $$\frac{Ts - Tdelay}{Ts},$$

the feedback signal FB is kept equal to the referential voltage signal Vbase, and the driving current reaches a maximum of Vbase/R0. In the embodiment, the function same as the current source circuit in the fourth embodiment can be achieved by simultaneously switching the first input signal at the first input terminal and the second input signal at the second input terminal of the operational transconductance amplifier. Thereby, segmental control of the feedback signal FB is achieved, and the feedback signal FB increases linearly and then keeps constant with the increasing duty cycle D.

It should be understood that the second voltage signal V2 in the embodiment may be a difference between the feedback signal FB and a preset threshold Vth. The switch circuit may switch the input signal of the operational transconductance amplifier among multiple voltages, by including more switches, so as to achieve the segmental control of the feedback signal.

In an embodiment, referring to the current adjustment circuit descripted in FIG. 11, the first voltage signal V1 may be selected to be 0V. It should be understood that the above value is merely provided as an example, and different voltage values may be selected to meet specific design requirements in different application environments.

Figure 12:
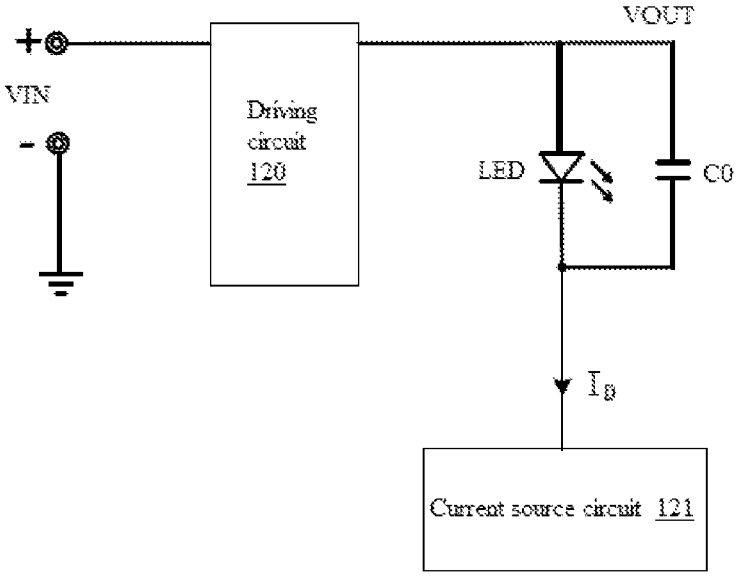
FIG. 12 is a circuit block diagram of an LED driving circuit according to an embodiment of the present disclosure.

FIG. 12 is a circuit diagram of an LED driving circuit according to an embodiment of the present disclosure.

The LED driving circuit 120 includes a driving circuit 120, a current source circuit 121, and an LED serving as a load and an output capacitor C0 that are connected in parallel. The driving circuit 120 is configured to convert an input voltage VIN into an output voltage VOUT, to drive a light source. In the embodiment, the light source is a light emitting diode (LED). An anode of the LED load and a first terminal of the output capacitor receive the output voltage VOUT. The current source circuit 121 is connected in series to a cathode of the LED load and a second terminal of the output capacitor, to provide a driving current ID flowing through the LED load.

The current source circuit 121 generates the driving current ID correlated with duty cycle information, based on a first control signal VD that includes the duty cycle information. In an embodiment, the first control signal VD is a PWM dimming signal, and the current source circuit 121 receives the PWM dimming signal and generates the driving current ID correlated with a duty cycle D of the PWM dimming signal. According to different duty cycles D, the current source circuit 121 adjusts the driving current ID such that the LED load has corresponding brightness. Thereby, dimming of the LED load is achieved.

The technical solutions of the embodiments of the present disclosure achieve linear control or segmental linear control of the feedback signal, by shunting the current at the output terminal of the operational transconductance amplifier or switching the input signal at the at least one input terminal of the operational transconductance amplifier, based on the first control signal that includes the duty cycle information. Thereby, the driving current generated by the current source circuit is correlated with the duty cycle information. According to the present disclosure, the current source circuit can be freed from a filtering circuit, an amplitude modulation circuit and the like. The circuit design is simplified, and the system efficiency is improved.

Described above are only preferable embodiments of the present disclosure, and the present disclosure are not limited thereto. Those skilled in the art can make various modifications and variations to the present disclosure. Any modification, equivalent replacement, modification, or the like that is made within the spirit and principle of the present disclosure should fall within the protection scope of the present disclosure.

The invention claimed is:

1. A current source circuit for generating a driving current, comprising:

a first-control-signal generation circuit, configured to receive a PWM dimming signal to generate a first control signal;

a current adjustment circuit, configured to:

receive a referential voltage signal determined by a parameter of the current source circuit, a feedback signal characterizing the driving current, and the first control signal that comprises duty cycle information, and control an output current of the current adjustment circuit based on the first control signal;

a driving-voltage generation circuit, configured to generate a driving voltage based on the output current; and a current generation circuit, configured to generate the driving current based on the driving voltage, wherein the driving current is correlated with the duty cycle information, wherein the current adjustment circuit comprises an operational transconductance amplifier, a first input terminal of the operational transconductance amplifier receives the referential voltage signal or a first voltage signal, based on the first control signal, wherein in a case that a duty cycle of the PWM dimming signal is greater than a preset value, the first control signal is kept in a first state, the first input terminal receives the referential voltage signal, and the feedback signal is controlled to be equal to the referential voltage signal, and in a case that the duty cycle of the PWM dimming signal is less than or equal to the preset value, the first control signal is switched between the first and a second state, an input signal of the first input terminal is switched between the referential voltage signal and the first voltage signal, and the feedback signal is adjusted to be linear with the duty cycle.

2. The current source circuit according to claim 1, wherein the current adjustment circuit is configured to adjust a current at an output terminal of the operational transconductance amplifier based on the first control signal, in order to adjust the output current of the current adjustment circuit.

3. The current source circuit according to claim 1, wherein the driving-voltage generation circuit comprises a filter circuit, configured to filter the output current to generate the driving voltage.

4. The current source circuit according to claim 1, wherein the current generation circuit comprises a transistor, and the driving voltage controls a voltage at a control terminal of the transistor to generate the driving current flowing through the transistor.

5. The current source circuit according to claim 2, wherein a second input terminal of the operational transconductance amplifier receives the feedback signal or a second voltage signal based on the first control signal, to adjust the output current of the current adjustment circuit.

6. The current source circuit according to claim 1, wherein the first-control-signal generation circuit comprises a detection circuit, configured to receive the PWM dimming signal, and detect the duty cycle of the PWM dimming signal to generate a detection signal based on a timing reference correlated with the preset value; and an OR gate, configured to generate the first control signal based on the PWM dimming signal and the detection signal.

7. The current source circuit according to claim 1, wherein a second input terminal of the operational transconductance amplifier receives the feedback signal.

8. The current source circuit according to claim 1, wherein an input signal of a second input terminal of the operational transconductance amplifier is the feedback signal, in a case that the duty cycle of the PWM dimming signal is greater than the preset value; and the input signal of the second input terminal of the operational transconductance amplifier is switched between the feedback signal and a second voltage signal, and the feedback signal is adjusted to be linear with the duty cycle, in a case that the duty cycle of the PWM dimming signal is less than or equal to the preset value.

9. The current source circuit according to claim 8, wherein the second voltage signal is a difference between the feedback signal and a predetermined threshold, or a sum of the feedback signal and a predetermined threshold.

10. An LED driving circuit, comprising:

the current source circuit according to claim 1, and a driving circuit;

wherein the driving circuit receives an input voltage and converts the input voltage to an output voltage to drive an LED serving as a load, and wherein the current source circuit is coupled in series with the LED serving as the load, to provide the driving current flowing through the LED serving as the load.

* * * * *